US005174503A

United States Patent [19]

Gasaway

[11] Patent Number: 5,174,503

[45] Date of Patent: Dec. 29, 1992

[54] SHOWER MOUNTED PLURAL LIQUIDS DISPENSER

[76] Inventor: Douglas W. Gasaway, 5048 Gordon Rd., Senoia, Ga. 30276

[21] Appl. No.: 719,931

[22] Filed: Jun. 24, 1991

[51] Int. Cl.[5] ..... B05B 7/30

[52] U.S. Cl. ..... 239/307; 239/318; 239/416.1; 239/525; 239/586; 239/588; 222/132; 222/144.5

[58] Field of Search ..... 239/303-305, 239/307, 310, 318, 350, 349, 413, 416.1, 417.5, 428, 434, 443, 436, 525, 586, 588; 222/129, 144.5, 145, 132

[56] References Cited

U.S. PATENT DOCUMENTS

| | | | |
|---|---|---|---|
| 3,078,471 | 2/1963 | Knibb | 222/383 |
| 3,333,601 | 8/1967 | Lofgreen | 239/318 |
| 3,612,355 | 10/1971 | Stucky | 222/144.5 |
| 3,720,352 | 3/1973 | Kozlowski | 239/305 |
| 3,917,172 | 11/1975 | O'Hare | 239/307 |
| 4,191,332 | 3/1980 | De Langis et al. | 239/586 |
| 4,200,206 | 4/1980 | Chase et al. | 239/307 |
| 4,203,551 | 5/1980 | Levine | 239/443 |
| 4,218,013 | 8/1980 | Davison | 239/318 |
| 4,358,056 | 11/1982 | Greenhut et al. | 239/318 |
| 4,998,647 | 3/1991 | Sharp | 222/181 |
| 5,012,536 | 5/1991 | Rivera | 4/605 |

*Primary Examiner*—Andres Kashnikow
*Assistant Examiner*—Karen B. Merritt
*Attorney, Agent, or Firm*—H. Jay Spiegel

[57] ABSTRACT

A shower mounted plural liquids dispenser is disclosed which includes a housing designed to have a plurality of bottles containing diverse liquids coupled to it. The liquids may be dispensed either through the use of aspirating pump structure or through the use of discharge assisting pumping devices. The inventive dispenser also includes a hand-held sprayer controllable by a valve.

8 Claims, 3 Drawing Sheets

SHOWER MOUNTED PLURAL LIQUIDS DISPENSER

BACKGROUND OF THE INVENTION

The present invention relates to a shower mounted plural liquids dispenser.

In the prior art, it is generally known to provide a device for mounting within a shower and intended to be used to dispense liquids as desired.

U.S. Pat. Nos. 4,295,612 to Betsinger et al., 4,392,508 to Switall, 4,493,435 to Hartley, 4,560,089 to McMillin et al. and 4,666,430 to Brown et al. are known to Applicant.

Betsinger et al., in particular, teach a device designed to be mounted in a shower and allowing mixing of liquids with shower water. However, neither Betsinger et al. nor any of the other above listed United States Patents teaches all of the aspects and features of the present invention.

SUMMARY OF THE INVENTION

The present invention relates to a shower mounted plural liquids dispenser. The present invention includes the following interrelated objects, aspects and features:

(a) In a first aspect, the inventive dispenser includes a housing having couplings designed to allow coupling thereto of a multiplicity of bottles each of which contains a liquid which is to be dispensed. Preferably, these couplings are of the threaded type.

(b) In a further aspect, some of these couplings couple an individual bottle to a valve whereas others of these couplings connect a particular bottle to a displacement pumptype dispenser. The valves are connected to the nozzle of the existing shower plumbing via an entrance port to a restricted orifice in the nozzle supply line. Each valve may be adjusted to meter the desired amount of flow from an individual volume based upon the vacuum caused at the restricted orifice.

(c) In addition, the housing may have attached thereto an elongated flexible conduit with an auxiliary nozzle attached thereto and with the housing having a further conduit fluidly connected to the elongated flexible conduit at one end thereof via the housing and at another end thereof to the fluid supply conduit to the existing nozzle. Valve means are provided to allow diversion of flow from the existing nozzle to the auxiliary nozzle as desired.

As such, it is a first object of the present invention to provide a shower mounted plural liquids dispenser.

It is a further object of the present invention to provide such a device having a plurality of bottles coupled thereto some of which may dispense liquids through the existing nozzle of the shower and others of which may dispense liquids through the use of displacement pumptype dispensers.

It is a yet further object of the present invention to provide such a device wherein an auxiliary nozzle is provided.

It is a still further object of the present invention to provide such a device wherein valve means are employed to allow metering of flow from some of the bottles.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
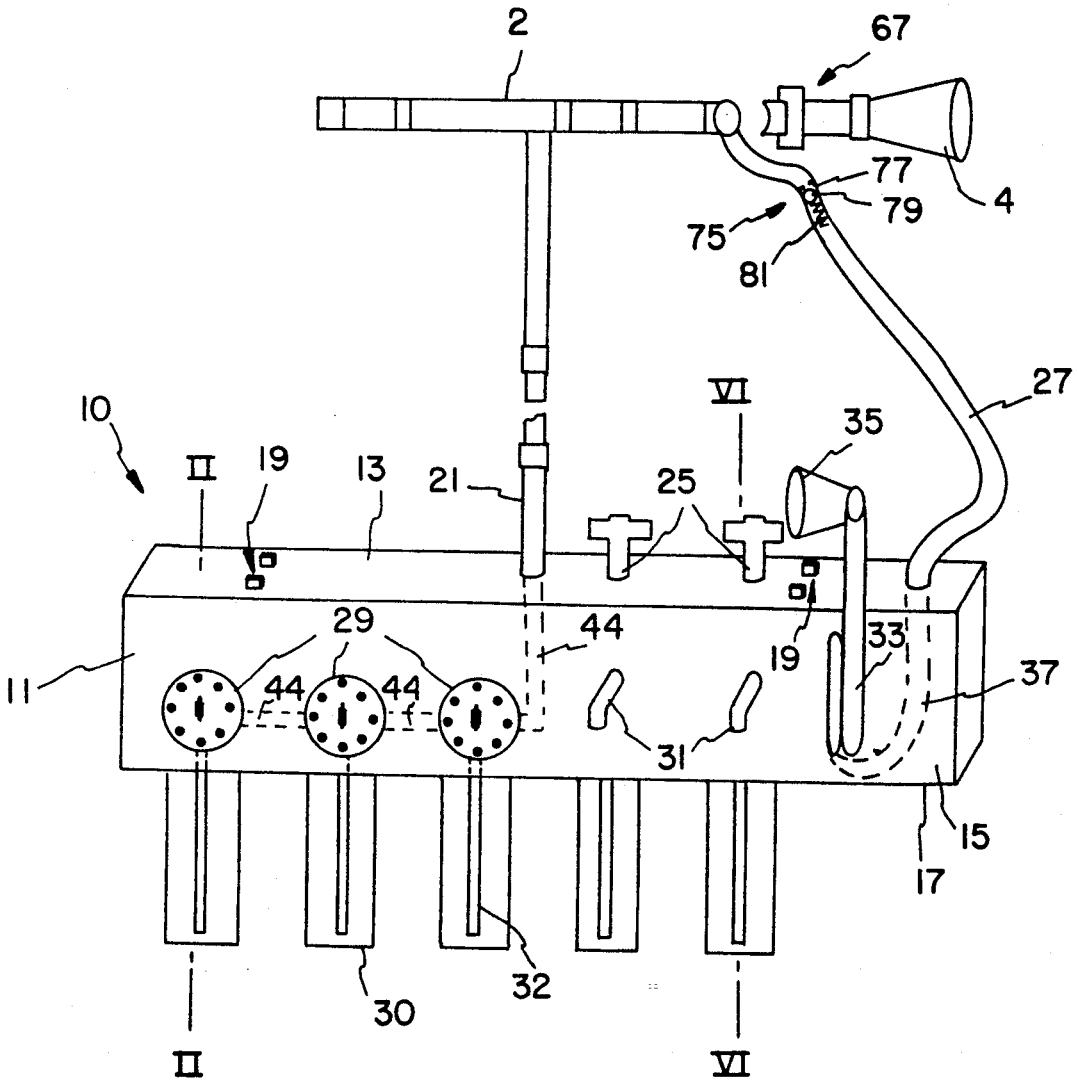
FIG. 1 shows a schematic representation of the preferred embodiment of the present invention.

With reference, first, to FIG. 1, the present invention is generally designated by the reference numeral 10 and is seen to include a housing 11 having a top wall 13, a front wall 15 and a bottom wall 17.

The top wall 13 includes mounting brackets 19 of any suitable type as well as connection of a conduit 21 from the interior of the housing 11 up to the conduit 2 of the existing shower water supply system.

With further reference to FIG. 1, it is seen that the top wall 13 of the housing 11 also includes pump actuators 25 and connection of a conduit 27 which also connects to the existing water supply conduit 2 as will be described in greater detail hereinafter.

The front wall 15 of the housing 11 has mounted thereon the actuators 29 of valves to be described in greater detail hereinafter as well as the nozzle outlets 31 associated with the pump actuators 25 as will be described in greater detail hereinafter. Additionally, the front wall 15 of the housing 11 has mounted thereto the flexible conduit 33 of a hand-held spraying mechanism including a nozzle 35, which mechanism is fluidly connected to the conduit 27 via a further conduit 37 within the housing 11 and shown in phantom in FIG. 1.

The bottom wall 17 of the housing 11 has mounted thereto a multiplicity of bottles 30 as will be described in greater detail hereinafter, with each bottle 30 having inserted therein a draw tube 32 as also will be described in greater detail hereinafter.

Figure 2:
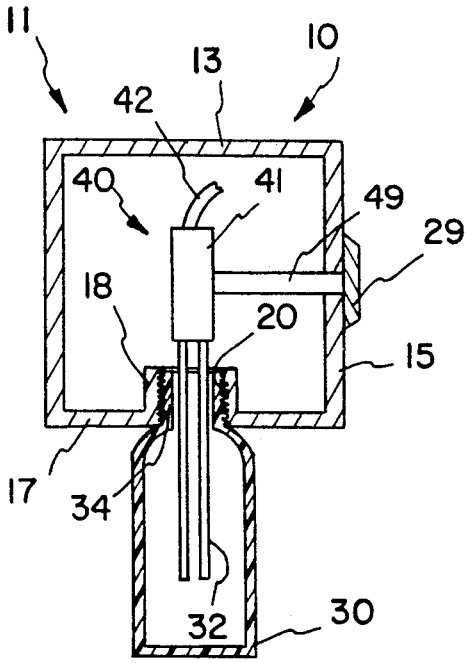
FIG. 2 shows a cross-sectional view along the line II—II of FIG. 1.
Figure 3:
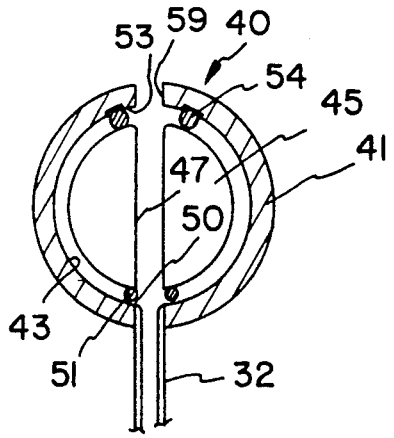
FIG. 3 shows a cross-sectional view through the valve illustrated in FIG. 2.

With reference, now, to FIGS. 2 and 3, it is seen that each bottle 30 is coupled to the bottom wall 17 of the housing 11 by a fitting 18 having an opening 20 the surfaces of which are threaded in a manner complimentary to the external threads of a neck portion 34 of the bottle 30. Thus, the bottle 30 may easily be coupled to the bottom wall 17 by concurrent rotative and reciprocatory movements thereof and may just as easily be uncoupled therefrom. As seen with further reference to FIGS. 2 and 3, the tube 32 is connected to a valve 40 having a housing 41 and a valve chamber 43. The valve head 45 includes a passageway 47 therethrough with the valve head 45 being connected to the actuator 29 via the stem 49 shown in FIG. 2.

With reference to FIG. 3, it is seen that an O-ring 51 surrounds the inlet port 50 of the valve chamber 43 while an O-ring 54 surrounds the outlet port 53 of the valve chamber 43. As shown in FIG. 3, the 0-ring 54 is larger than the O-ring 51. This is so that regardless of the rotative position of the valve head 45 and the passageway 47 with respect to the inlet port 50, connection will be made to the outlet port 53 so that at any metered position of the valve head 45, flow will occur out the outlet 59 of the housing 41, provided, of course, that some portion of the entranceway of the flow passageway 47 is within the area of the O-ring 51.

Figure 4:
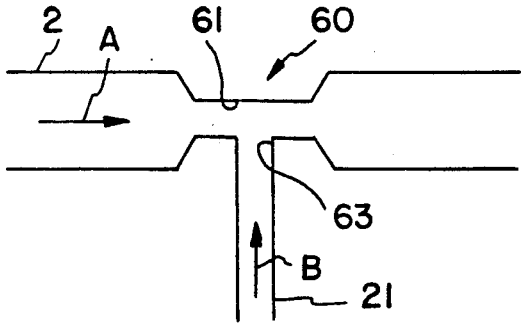
FIG. 4 shows a schematic representation of the restricted orifice and connecting port of the present invention.

With reference to FIG. 4, the interconnection of the conduit 21 and the existing conduit 2 is shown. In particular, the conduit 2 is modified by providing a restricted orifice 60 having a throat 61 with an entrance port 63 being provided at the throat 61 and with the conduit 21 being coupled to the conduit 2 at the port 63.

With this configuration, flow in the passageway 2 in the direction of the arrow A will result in a reduction of pressure at the throat 61 thereby causing a suction effect tending to move fluid in the passageway 21 in the direction of the arrow B. Thus, flow of water within the conduit 2 in the direction of the arrow A will result in the sucking of fluid from any of the containers 30 which have valves even partially opened.

With reference to FIG. 2, the valve 40 has an outlet conduit 42 which is interconnected into a common outlet conduit 44 shown in FIG. 1 and fluidly connected to the passageway 21. Each valve 40 has the same configuration, thus, if all of the valves 40 are at least partially opened, when water is flowing within the passageway 2, fluid will be sucked from each of the bottles 30 having valves 40 depending upon the degree of opening of the valves. Thus, through the use of the present invention, one may suck fluid from one or more of the bottles 30 simultaneously, thus, allowing mixing of fluids from diverse bottles 30 in desired proportions based upon the degree of opening of the respective valves 40.

Figure 5:
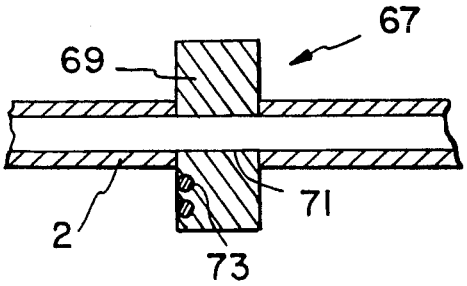
FIG. 5 shows a cross-sectional view through a diverter valve forming a part of the present invention.

With reference, now, to FIGS. 1 and 5, it is seen that the passageway 2 has an outlet valve 67 designed to control flow of fluid in the passageway 2 to the nozzle 4. With reference to FIG. 5, the valve 67 is seen to include a valve head 69 having a passageway 71 therethrough as well as a blocking portion having an O-ring 73. In the position shown in FIG. 5, with the passageway 71 through the valve head 69 aligned with the conduit 2, free flow of water to the nozzle 4 may occur. When it is desired to stop the free flow of water to the nozzle 4, the valve head 69 is reciprocated upwardly in the view of FIG. 5 to cause the blocking portion to align with the passageway, thus precluding any flow past the valve head 69. The O-ring 73 prevents leakage between the passageway 2 and the valve head 69.

With further reference to FIG. 1, it is seen that the conduit 27 is connected to the passageway 2 upstream of the valve 67. Within the conduit 27, a check valve 75 is provided having a seat 77, a valve head 79 and a spring 81 biasing the valve head 79 in the direction of the conduit 2. The spring constant of the spring 81 is set so that with the valve 67 in the opened position illustrated in FIG. 5, the spring constant of the spring 81 is strong enough to preclude flow past the valve head 79. However, when the valve head 69 is moved to the closed position thereof, the pressure of fluid within the passageway 2 entering the conduit 27 will be sufficient to overcome the spring force of the spring 81 to thereby allow fluid to flow within the conduit 27 within the conduit 37 and thence through the flexible conduit 33 to the nozzle 35. The nozzle 35 may be held in one's hand and may be used as a hand-held shower nozzle.

Figure 6:
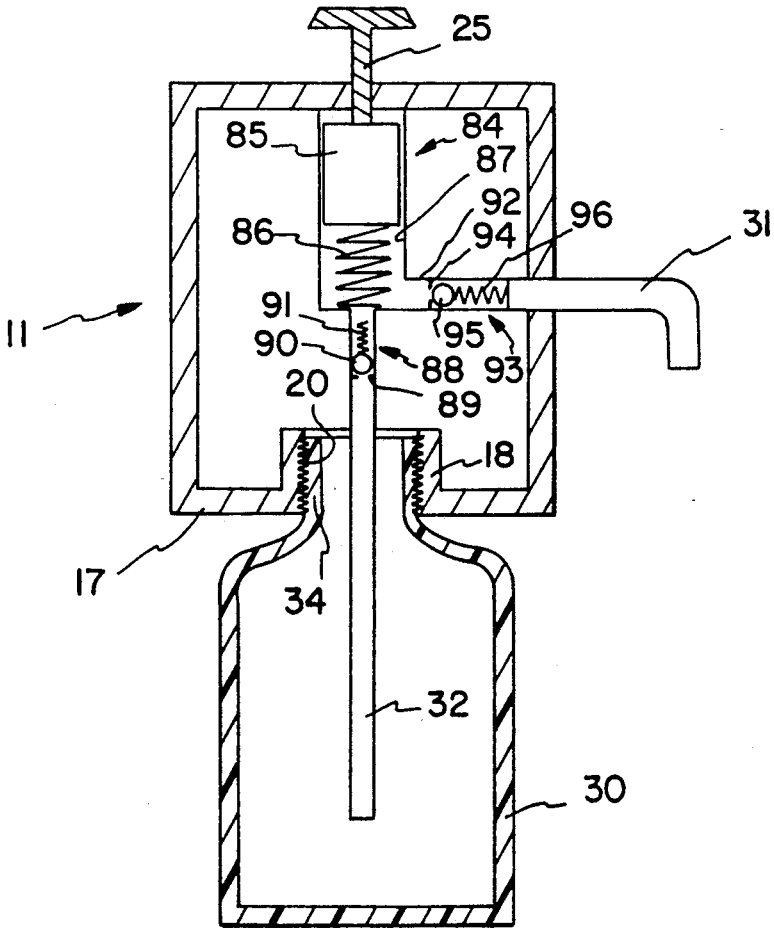
FIG. 6 shows a cross-sectional view along the line VI—VI of FIG. 1.

With reference, now, to FIG. 6, it is seen that a further bottle 30 is coupled to the housing 11 via a further fitting 18 having inner threaded walls 20 designed to intermesh with the threaded outer walls of the neck 34 of the bottle 30. The tube 32 is seen to be connected to the inlet of a pump mechanism 84 which includes a piston 85 spring biased in the upward direction by the spring 86 and attached to the actuating handle 25.

Within the tube 32, a check valve 88 is provided including a seat 89, a valve head 90 and a spring 91 generally biasing the valve head 90 in the downward direction in the view of FIG. 6. The outlet nozzle 31 is also connected to the pump 84 via a conduit 92 having a further check valve 93 therein including a valve seat 94, a valve head 95 and a spring 96 biasing the valve head 95 in the direction of the pump 84.

As should be understood by those skilled in the art with this explanation having been read, with the pump in the position shown in FIG. 6, depression of the handle 25 downwardly will cause the piston 85 to move downwardly thereby dispensing any fluid contained within the pump chamber 87. In this position, when the handle 25 is released, the spring 86 will cause the piston 85 to move upwardly in the view of FIG. 6. During this movement, fluid will be sucked from the container 30 up the tube 32 past the check valve 88 and into the pump chamber 87. Subsequently, reciprocation downwardly of the handle 25 will result in closure of the check valve 88, opening of the check valve 93 and dispensing of further fluid out the nozzle 31.

The brackets 19 may be used to mount the device 10 in a suitable location within the shower, preferably, in a location below the conduit 2.

Through the use of the present invention, a variety of fluids may be contained within the containers 30 and may be selectively dispensed as desired. Thus, for example, the containers associated with the pumps 84 may be filled with shampoo and soap, respectively, while the containers associated with the valves 40 may be filled with appropriate conditioners or other aromatic liquids.

As such, an invention has been disclosed in terms of a preferred embodiment thereof which fulfills each and every one of the objects of the invention and provides a new and useful shower mounted plural liquids dispenser of great novelty and utility. Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A dispenser comprising:

a) a housing having a plurality of openings;

b) each of said openings being adapted to receive a container;

c) at least one of said openings being connected to an outlet conduit of said housing via an adjustable metering valve;

d) at least another one of said openings being connected to a discharge nozzle via a pump;

e) said outlet conduit having a first end fluidly connected to said at least one of said openings and a second end connected to a throat of a restricted orifice located in a flow line, whereby with said valve at least partially open, a container attached to said at least one of said openings and fluid flowing through said flow line, liquid is sucked from said container and enters said flow line at said throat;

f) said housing having a hand holdable shower nozzle attached thereto via a flexible hose and fluidly connected to said flow line, said flow line having valve means downstream of said hose.

2. The invention of claim 1, wherein said at least one of said openings comprises three openings.

3. The invention of claim 1, wherein said at least another of said openings comprises two openings.

4. The invention of claim 1, wherein said pump comprises a piston reciprocable in a cylinder.

5. The invention of claim 1, wherein each said adjustable metering valve comprises a plug valve having a plug with a passageway therethrough and an actuator for rotating said plug.

6. The invention of claim 1, wherein said flow line comprises a shower nozzle supply line.

7. The invention of claim 6, wherein said housing includes brackets for mounting said dispenser in a shower stall.

8. The invention of claim 1, wherein said hose has a check valve therein.

* * * * *